US005353726A

United States Patent [19]

Bruder et al.

[11] Patent Number: 5,353,726

[45] Date of Patent: Oct. 11, 1994

[54] METHOD OF MONITORING THE SUPPLY OF LOOPER THREAD OF A DOUBLE LOCK-STITCH SEWING MACHINE

[75] Inventors: Wolfgang Bruder; Horst Bohl, both of Bielefeld; Reinhard Backmann, Heimbuchenthal, all of Fed. Rep. of Germany

[73] Assignee: Dürkopp Adler Aktiengesellschaft, Fed. Rep. of Germany

[21] Appl. No.: 949,808

[22] PCT Filed: Jul. 13, 1991

[86] PCT No.: PCT/EP91/01320

§ 371 Date: Dec. 15, 1992

§ 102(e) Date: Dec. 15, 1992

[87] PCT Pub. No.: WO92/02673

PCT Pub. Date: Feb. 20, 1992

[30] Foreign Application Priority Data

Aug. 7, 1990 [DE] Fed. Rep. of Germany ..... 4024989
Jun. 3, 1991 [DE] Fed. Rep. of Germany ..... 4118158

[51] Int. Cl.[5] ..... D05B 59/02
[52] U.S. Cl. ..... 112/262.1; 112/278
[58] Field of Search ..... 242/37 R; 112/273, 275, 112/278, 121.11, 262.1

[56] References Cited

U.S. PATENT DOCUMENTS 5,018,465 5/1991 Hager et al. .
5,161,475 11/1992 Tawara et al. ..... 112/278
5,211,121 5/1993 Sakakibara ..... 112/278

FOREIGN PATENT DOCUMENTS 3540126 2/1987 Fed. Rep. of Germany .
3625630A1 2/1988 Fed. Rep. of Germany .
2600085 12/1987 France .
8903908 5/1989 PCT Int'l Appl. .

*Primary Examiner*—Clifford D. Crowder
*Assistant Examiner*—Paul C. Lewis
*Attorney, Agent, or Firm*—Ostrolenk, Faber, Gerb & Soffen

[57] ABSTRACT

Fastened to the bobbin for reception of the supply of looper thread which is inserted in the looper of a sewing machine, there is a data carrier (22) in which there is stored data which describe the supply of looper thread present on the bobbin with respect to the amount thereon and possibly also the nature of the sewing thread wound thereon. The data carrier is scanned by a sensor which preferably includes a first read/write head (27) and a second read/write head. After the winding of an empty bobbin, the data defining the supply of looper thread is recorded by said second read/write head in the data carrier of the said bobbin. After the sewing has been effected, the data defining the existing supply of looper thread is entered/read with the first read/write head in/from the data carrier of the corresponding bobbin. Thus, the bobbin provides information at any time as to the supply of looper thread present on it.

7 Claims, 7 Drawing Sheets

Fig. 7
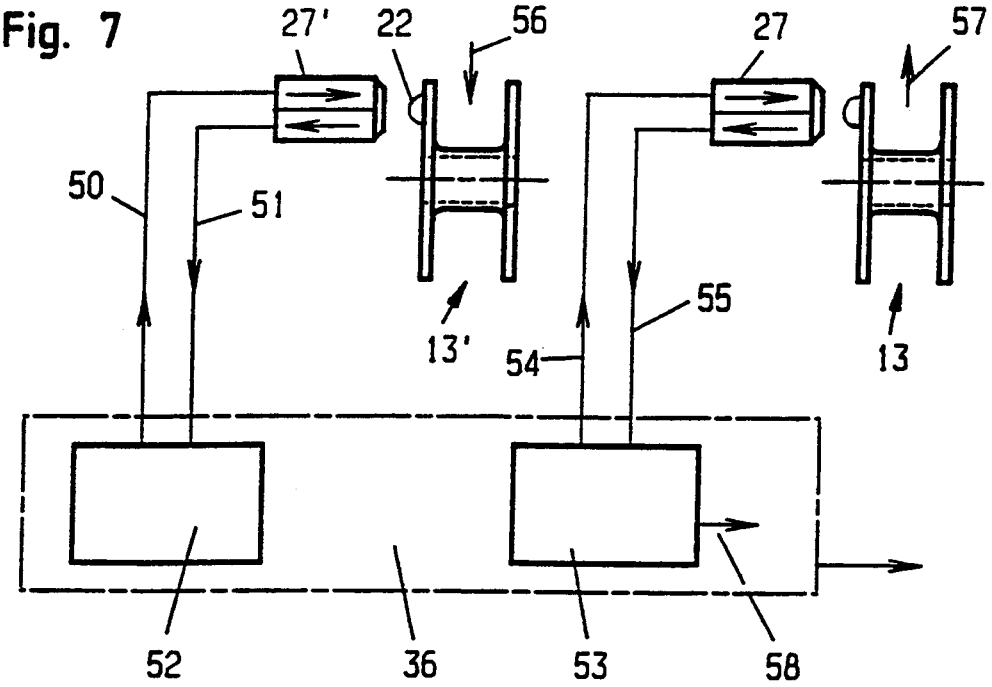
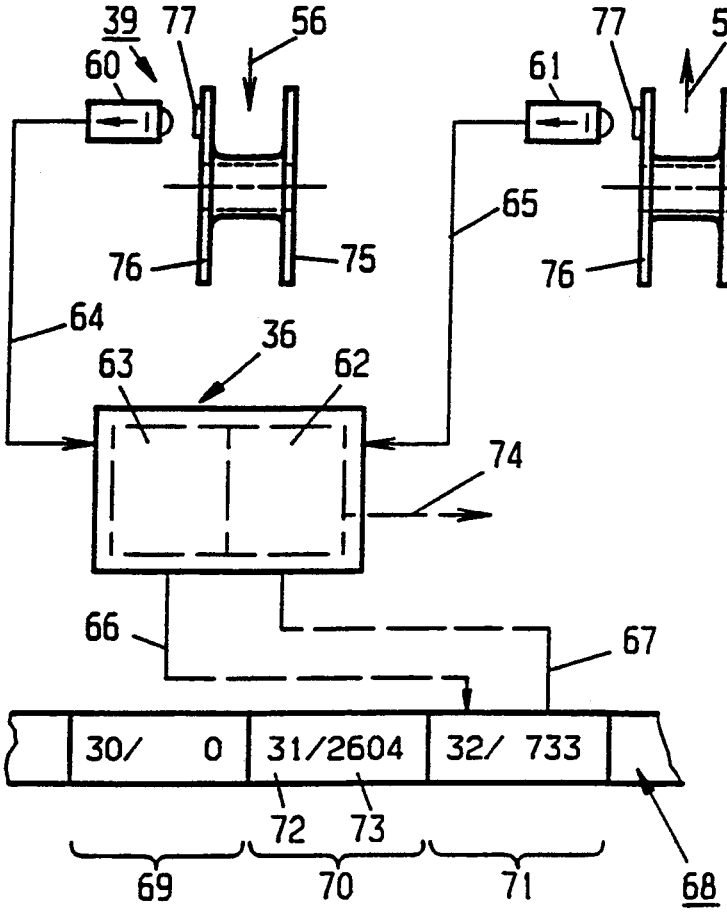
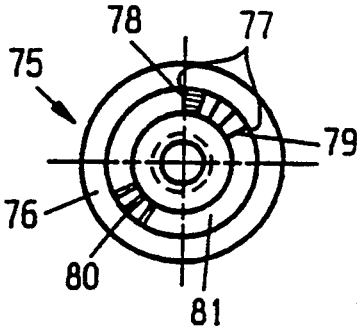
Fig. 9
Fig. 8

METHOD OF MONITORING THE SUPPLY OF LOOPER THREAD OF A DOUBLE LOCK-STITCH SEWING MACHINE

BACKGROUND OF THE INVENTION

1. Field of the Invention

The present invention relates to a method of monitoring the supply of looper thread, in particular, a method by which information as to the existing supply of thread on the bobbin of looper thread ready for sewing can be obtained at any time.

2. Description of the Related Prior Art

A thread-monitoring device of related interest is known from German Unexamined Application for Patent DE-OS 36 25 630 A1. The known thread-monitoring device consists essentially of a sensor unit, a data processing unit, and a signal device. The sensor unit has a source of light, for instance a light transmitter, as well as a light receiver, for instance a photodetector. A beam of light which is sent out by the source of light is directed onto a bobbin which is provided to contain the supply of looper thread and which is incorporated in a bobbin case, also referred to as bobbin-housing upper part, of a rotating lock-stitch looper. Said beam of light passes in this connection through an opening provided in the bobbin case and thus strikes the outside of a front flange, the outside being provided with black light-absorbing and white light-reflecting markings. Said bobbin briefly carries out a turning movement within a period of time during which the amount of thread required for the formation of a lock-stitch is withdrawn from the supply of looper thread present on the bobbin. Upon this turning movement of the bobbin, the sensor unit scans the alternate black and white markings, as a result of which electric pulses are produced. These pulses are fed to a data processing unit and a signal device, whereby the supply of looper thread present on the bobbin is monitored. This monitoring is based on an evaluation of the continuously changing conditions of reflection, which permit corresponding conclusions as to the rotation of the bobbin and the existing supply of looper thread on the bobbin. When a predetermined residual amount of thread still present on the bobbin is reached, the signal device gives off a visual and/or acoustic warning signal.

The disadvantage of the known monitoring device is that the said monitoring refers only to the conditions "bobbin full; bobbin empty; thread tear", while an indication as to the condition with respect to the supply of thread at hand at the time is not possible.

From French Unexamined Application No. 2 600 085, it is furthermore known to provide scannable reflection surfaces on the flange of the bobbin. Upon opto-electronic scanning of the reflection surfaces, pulses are produced which represent a measure of the supply of looper thread present on the bobbin. Since the solution proposed does not provide for any possibility of storing the data defining the supply of looper thread, the bobbin-specific data describing the supply of looper thread are lost as soon as the bobbin in question is removed from the looper and separated from the sewing machine. From said application, to be sure, a detection of the pulses via a marking on the outside of a flange of the bobbin, both upon the winding and upon the sewing, is known, but, aside from this, no indication can be obtained by which it is possible to note the existing state of fullness of the bobbin by means of the pulses detected and the geometrical data of said bobbin.

SUMMARY OF THE INVENTION

The object of the present invention is, therefore, so further to develop a device of this type for the monitoring of the supply of looper thread and provide a method for monitoring the supply of looper thread that information as to the existing supply of thread on the bobbin of looper thread ready for sewing can be obtained at any time, whatever the extent to which the bobbin is full.

In the method of the invention, this object is achieved by a method of monitoring the looper-thread supply in a double lock-stitch sewing machine in which, by detection of a marking provided on the outside of a bobbin present in the looper, pulses are detected by a sensor upon the winding due to the rotation of the bobbin and are given off to at least one counter and in which, furthermore, pulses are detected during the sewing by the intermittent rotation of the bobbin by a further sensor and given off to at least one counter. The method including the steps of: identifying the bobbin by a marking on the outside of a flange on the bobbin; detecting by a first sensor further marks on the outside of the flange of the bobbin upon winding as pulses which influence the degree of filling F of the bobbin and are incremented by the counter to the number of pulses $Z_{max}$; detecting by a second sensor the marks during the sewing as pulses which affect the consumption of looper thread and decremented in the counter to the pulse number $Z_{act}$; inputting via a keyboard forming part of a computer unit the diameter D of the bobbin as well as the diameter d of a bobbin hub; calculating in the computer unit a number of pulses $Z_R$ influencing the instantaneous degree of filling F of the bobbin by subtraction of $Z_{max}$ and $Z_{act}$; determining values of a thread length $L_{max}$ corresponding to the number of pulses $Z_{max}$ and a remaining length of thread $L_R$ from the diameter of the bobbin; and indicating on a display forming part of the computer unit the number of pulses $Z_{max}$ and the corresponding thread length $L_{max}$, as well as the number of pulses $Z_{act}$ and, at the end of the sewing, the number of pulses $Z_R$ as well as the remaining length of thread $L_R$ still present at this time on the bobbin.

By the device in accordance with the invention, the result is advantageously obtained that the instantaneous supply of thread on a looper-thread bobbin can be noted with respect to quantity and possibly nature of the sewing thread wound thereon at any time—starting from a full bobbin up to an empty bobbin—since every change in the amount of filling is recorded in a storage, referred to as a data carrier.

By the present invention, it is possible to use the bobbin provided with the data carrier in sewing machines which are independent of each other, i.e. in their loopers.

Moreover, assurance is had that the reading or writing of data defining the supply of thread is effected in the immediate vicinity of the double lock-stitch looper.

With the development in accordance with FIG. 8, a read/write station which is arranged separately from the sewing machine is provided, it permitting the reading or writing of the data indicating the supply of thread on the bobbin at a distance in space from the sewing machine.

Another solution of the object is obtained by a particularly simple and economical construction of the bobbin as well as a simple construction of the sensor, thus resulting in an inexpensive, dependably operating device for monitoring the looper-thread supply of a sewing machine.

By the method of the invention, the result is advantageously obtained that the sewing machine operator is continuously advised as to the degree of filling F and the remaining length of thread $L_R$ present on the bobbin by visual indication and that, when a predeterminable tolerance threshold of the practically empty bobbin is reached, an acoustic and/or visual signal indicates the fact that the looper-thread bobbin is about to be empty.

BRIEF DESCRIPTION OF THE DRAWING

Several embodiments will be explained now with reference to FIGS. 1 to 13 of the drawing, in which:

FIG. 7 is a block diagram of the device according to the invention which serves to explain the scanning of the data carrier provided on the bobbin, upon both the winding and the unwinding;

FIG. 8 is a block diagram of another solution in accordance with independent claim 10;

FIG. 9 is a view of the flange of a bobbin for said other solution;

DETAILED DESCRIPTION OF EMBODIMENTS OF THE INVENTION

Figure 1:
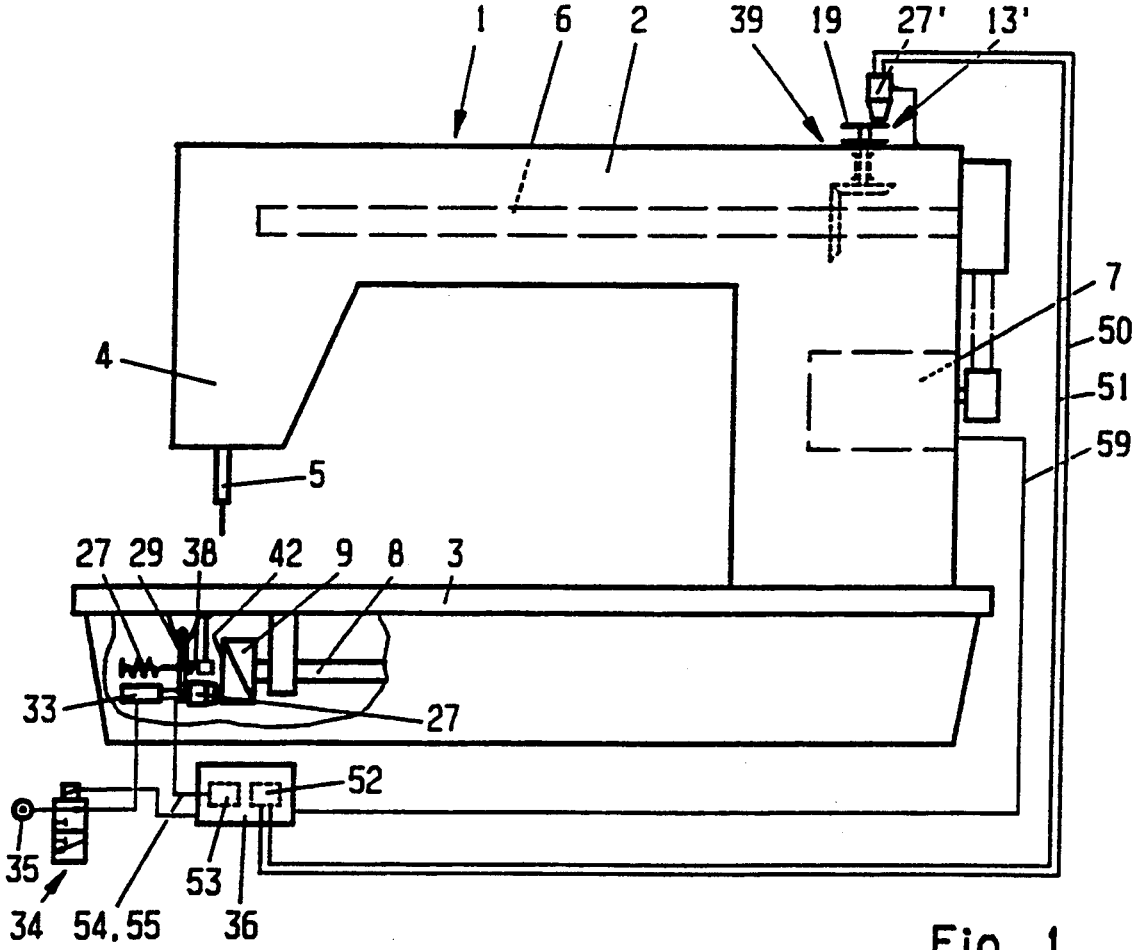
FIG. 1 is a simplified front view of a sewing machine which is provided with a device, integrated in the sewing machine, for monitoring the looper-thread supply.

FIG. 1 shows a traditional sewing machine 1 which consists essentially of an arm 2 and a base plate 3, the two being firmly attached to each other in known manner. On the front of the arm 2, there is an arm head 4 in which a needle bar 5 which can move up and down is mounted in known manner. The needle bar is driven by an arm shaft 6 which is multiply supported in the arm 2 and the right end of which, extending out of the arm 2, bears a hand wheel 6*a*. The arm shaft 6 is driven, as is known, via a pulling means, for instance a V-belt, merely indicated in FIGS. 1 and 6, by a sewing drive motor 7. Below the base plate 3, there is provided, among other things, a horizontally mounted looper shaft 8 which is driven in known manner from the arm shaft 6 via a toothed belt, not shown here. Of course, the device of the invention extends also to a looper with vertically mounted looper shaft, which embodiment has not been shown here. On the left end of the looper shaft 8 there is fastened a double-rotating lock-stitch looper 9 which, as is known, consists of a non-rotatable bobbin-housing lower part 10, a looper body 11 mounted rotatably on the circumference of said lower part 10, a bobbin-housing upper part 12 (referred to occasionally also as bobbin case) and a bobbin 13 which is inserted in the latter. The bobbin, after it has been inserted together with the bobbin-housing upper part 12 into the bobbin-housing lower part 10, is mounted turnably on a protruding spindle 14. The bobbin-housing lower part 10 bears the spindle 14, which is thus part of the bobbin-housing lower part 10. A nose 15, provided on the bobbin-housing upper part 12, engages, as is known, into a recess 16 in the bobbin-housing lower part 10 upon the above-described insertion of the bobbin-housing upper part 12. The position of the bobbin-housing upper part 12 in the bobbin-housing lower part 10 is secured by a swingable and displaceable flap 17 which, as is known, engages into a groove 18 provided at the front of the spindle 14.

Figure 3:
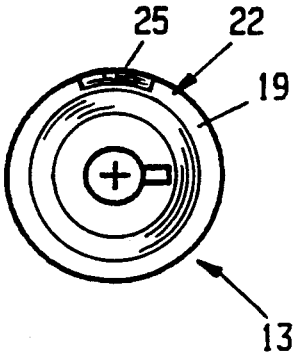
FIG. 3 is a front view of the looper-thread bobbin with data carrier provided thereon, developed as concentric magnetic track.
Figure 2:
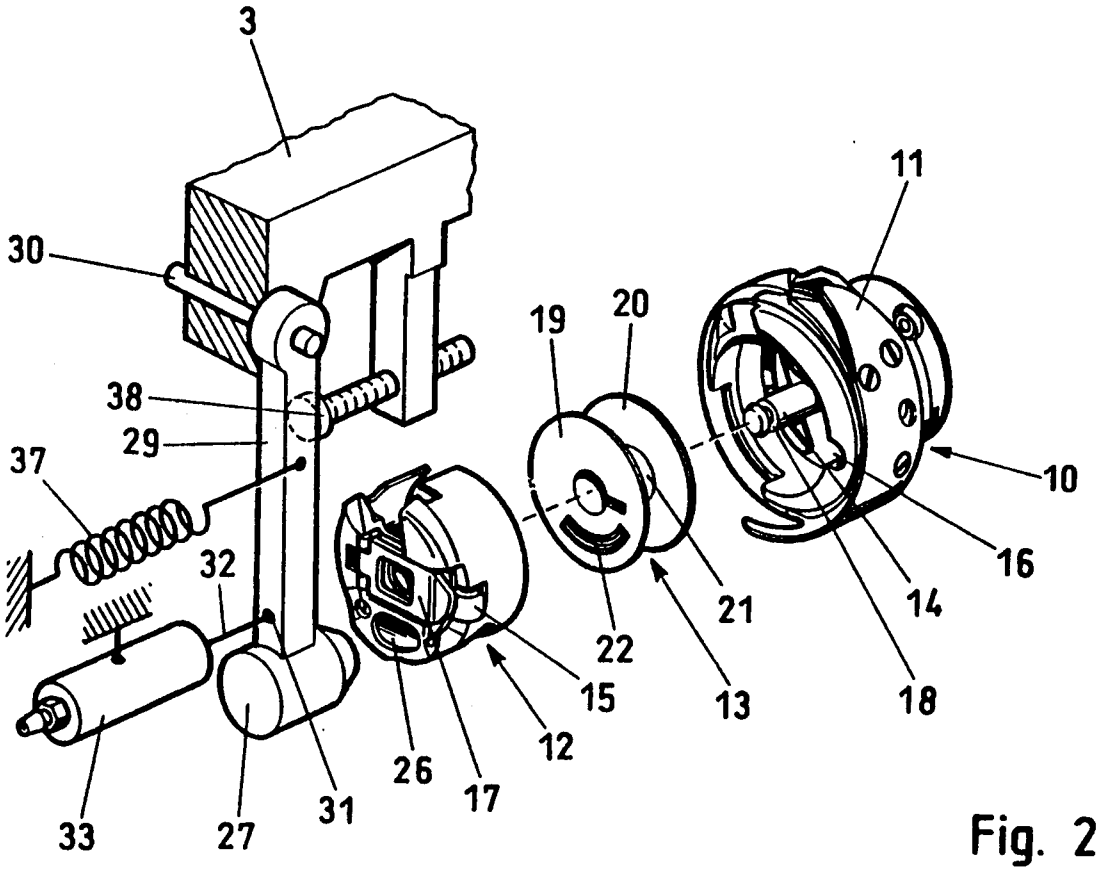
FIG. 2 is a simplified view in perspective of a rotating lock-stitch looper and a swingable read/write head provided for the monitoring of the looper-thread bobbin.

The bobbin 13 has a front flange 19 and a rear flange 20, the two being connected by a hub 21, as shown in FIG. 2. On the outside of the flange 19, there is provided a data carrier 22 which, in known manner, is developed either from foil-like material as magnetic track (see FIGS. 3 and 4) or as a magnetic strip (see FIG. 5). The latter is made of thick sheet-shaped material which is also used for the manufacture of magnetic cards. The data carriers 22 just discussed, which are made from foil-like or sheet-like material, are attached firmly to the outside of the flange 19 by the use of a suitable adhesive, preferably in such a manner that they do not extend beyond the outside of the flange 19. From FIG. 5, it can accordingly be noted that the magnetic strip made of thicker material is received by a groove 23 which is worked with only slight depth into the outside of the flange 19.

In another embodiment, not shown here, the data carrier 22 can be represented by a transmission and receiving device which is constructed in a hybrid circuit. This transmission and receiving device consists of two relatively flat processors which are fastened by a coating of casting resin to the flange 19 or 20 of the coil 13. In the vicinity of these processors, a very flat bobbin is provided on the opposite side of the flange 19 or 20, said coil being fastened also by a casting resin to the corresponding flange 19, 20. By a stationary magnet arranged in the vicinity of this coil, energy transmission then takes place. By this transmission, the processors are activated. As a result of the above-mentioned optional application of the data carrier 22 on the front flange 19 or the rear flange 20 (see FIG. 2), the sensor for the scanning of the data carrier 22 can be arranged either—as shown in FIG. 2—in front of the looper 9 or—not shown here—behind the looper. In accordance with FIG. 3, a further mark 25 can also be arranged on the outside of the flange 19, it being developed so as to contrast with its surroundings, for instance as a dark spot in the form of a color field which is pasted-on and arranged preferably somewhat depressed.

Figure 6:
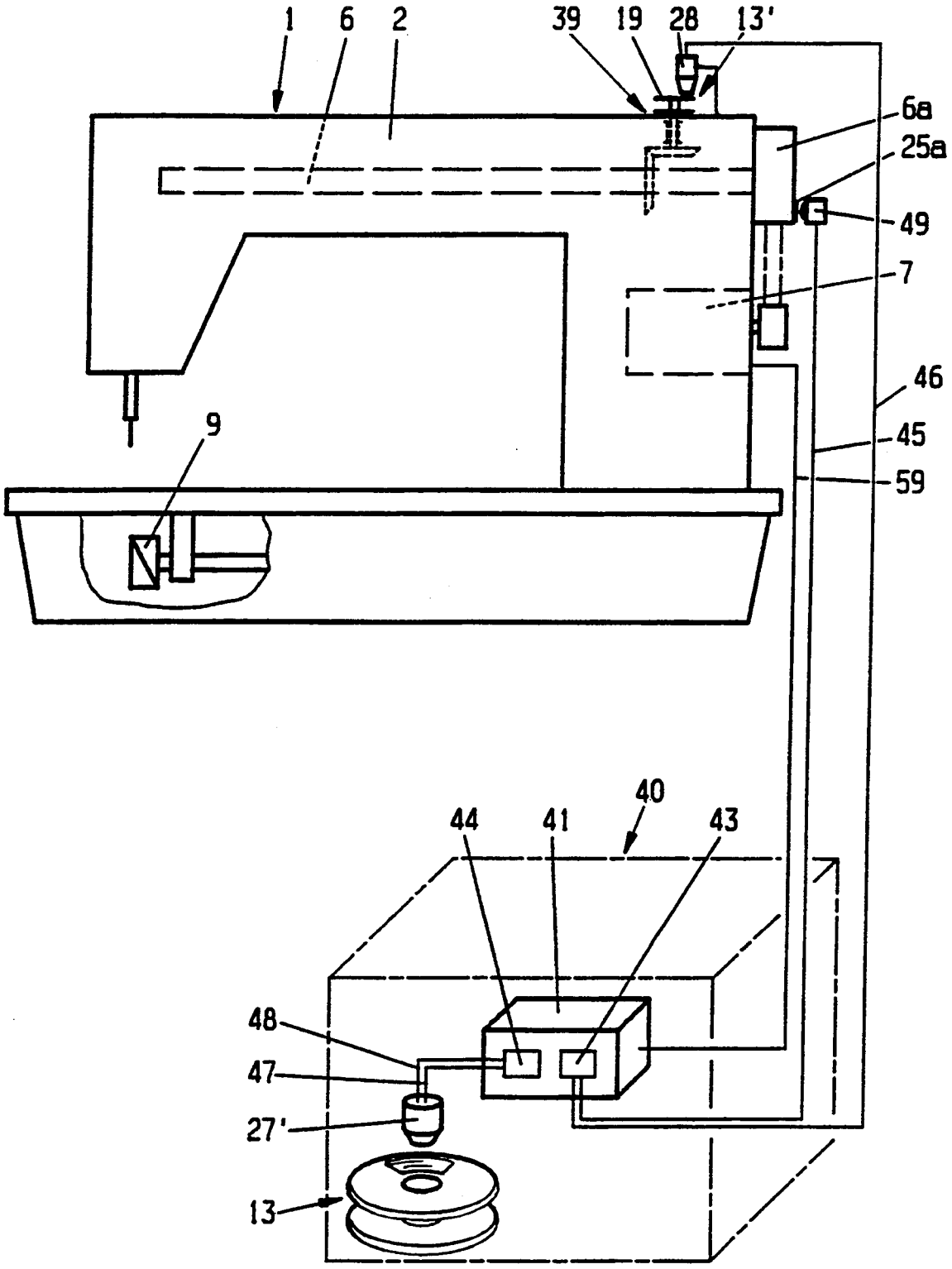
FIG. 6 is a simplified front view of a sewing machine which cooperates with a separate read/write station.

In the embodiment shown in FIG. 6, a further mark 25*a* is provided on the front of the handwheel 6*a*.

In the embodiment characterized by a horizontally supported looper shaft 8 (see FIG. 2), an opening 26 in accordance with FIG. 2 is provided in the front side of the bobbin-housing upper part 12, this opening permitting the unimpeded scanning of the mark 25 and/or of the data carrier 22. This scanning is made possible by a sensor device which consists, in the embodiment shown in FIGS. 1 and 2, substantially of a first read/write head 27 and a second read/write head 27'. The latter is fastened on the arm 2, while the read/write head 27 is fastened on a swing arm 29 which is swingably mounted around a pin 30 which is mounted in the base plate 3. A piston rod 32 of a mover 33 which is fastened to the frame acts on the swing arm 29 via a known ball-joint connection 31, which is merely indicated in FIG. 2. The mover 33 is represented, for instance, by a single-acting compressed-air cylinder which is acted on intermittently with compressed air via a commercial three-way/two-way solenoid valve 34, the compressed air being taken from an external source of compressed air 35. The time and duration of the action are determined by a control 36. A tension spring 37 is attached to the swing arm 29, it being connected at one end firmly to the frame via the base plate 3. By the extractable piston rod 32, the swing arm 29 is swung until it comes, in accordance with FIGS. 1 and 2, against an adjustable stop 38 which is mounted on the base plate 3. The adjustable stop 38 thus makes possible a minimum clearance between the read/write head 27 and an end surface 42 on the looper 9 whereby unimpeded passage of the needle-thread loop wrapping around the looper 9 is assured.

As shown in FIGS. 1 and 6, a winding device 39 by which an empty bobbin 13' can, as is known, be wound with sewing thread, is provided on the arm 2. The winding device 39 is driven, for instance, in known manner via a conical friction-wheel transmission from the arm shaft 6.

Of course, the winding (with sewing thread) of an empty bobbin 13' can also be effected at a separate station which is independent of the sewing machine 1.

In the aforementioned control 36, there are provided, among other things, a first counter/recording unit 52 and a second counter/recording unit 53. Of course, it is also possible for the two counter/recording units 52, 53 to be separated in space from each other and not—as shown in FIGS. 1 and 7—arranged in a common control 36. The counter/recording unit 52 is connected via the lines 50, 51 to the read/write head 27'. The counter/recording unit 53 is connected by the lines 54, 55 to the read/write head 27.

FIG. 6 shows a further embodiment of the invention which is characterized by the fact that, for the reading of the data contained in the data carrier 22 of the bobbin 13, as well as for the writing of the data defining the actual instantaneous supply of thread on the bobbin 13 into the data carrier 22, a read/write unit 40 which is separate from the sewing machine 1 is provided. With respect to the scanning of the data carrier 22 of a bobbin 13' present in the winding device 39, a write head 28 is fastened on the arm 2, in accordance with the embodiment shown in FIG. 6, this write head cooperating with another read head 49 which is fixed on the frame. This read head detects the marker 25*a* which, in accordance with FIG. 6, is provided on the hand wheel 6*a* connected to the arm shaft 6. The read/write station 40 has, in addition to a receiver (not shown here) for the bobbin 13, also a stationary read/write head 27' and a control 41. The latter contains a first counter/recording unit 43 and a second counter/recording unit 44. The write head 28 and the read head 40 are connected to the first counter/recording unit 43 via the lines 45, 46. The read/write head 27' is connected to the second counter/recording unit 44 in accordance with FIG. 6 via the lines 47, 48. Of course, it is also possible for the two counter/recording units 23, 24 to be arranged separately from each other and not—as shown in FIG. 6—in a common control 41.

The embodiment last described, which is shown in FIG. 6, differs from the embodiment shown in FIG. 1 and in the block diagram of FIG. 7 in the following manner: The bobbin 13' which is placed on the winding device 39 is described with respect to its data carrier 22 via the write head 28, the additional read head 49 determining the speed of rotation of the bobbin 13' by scanning the mark 25' which rotates with the hand wheel 6*a*. The said speed of rotation of the bobbin 13' is thus a measure of the supply of thread present on the bobbin 13. The pulses given off by the write head 28 are sent, via the line 46, to the first counter/recording unit 43. The pulses given off by the read head 49 are passed over the further line 45 also to the counter/recording unit 43 (see FIG. 6).

Figure 4:
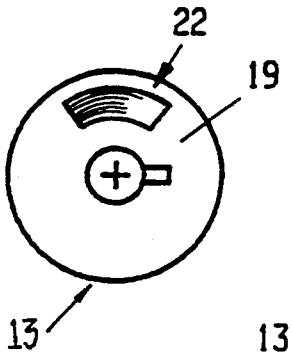
FIG. 4 is a front view of the looper-thread bobbin with data carrier provided thereon, developed as sector-shaped magnetic strip.
Figure 5:
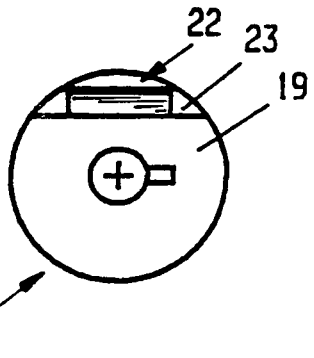
FIG. 5 is a front view of the looper-thread bobbin with a data carrier provided thereon in the shape of a beam.

In the above-described embodiments shown in FIGS. 1 and 6, the data carrier 22 serves, on the one hand, to receive or give off data as to the instantaneous supply of thread on the bobbin 13 and, on the other hand, to make each revolution of the bobbin 13 detectable, for which purpose the data carrier 22 is developed in accordance with FIGS. 4 and 5. This object can also be obtained with a bobbin 13 of different development which, in accordance with FIG. 3, has not only the data carrier 22 but also an additional mark 25. The latter must then be scanned by a separate read head, not shown in FIGS. 1 and 6 to 8.

The manner of operation of the device described will be described below with reference to the solutions shown in FIGS. 1, 6 and 7:

In the block diagram of FIG. 7, which refers to the embodiment shown in FIG. 1, the bobbin 13' is provided with an arrow 56 by which the winding onto the bobbin 13', and therefore the winding process for this bobbin, is symbolized. In FIG. 7, in contradistinction to this, the bobbin 13 is shown at a different place with an arrow 57 whereby the unwinding of the bobbin 13, and therefore the process during the sewing, is symbolically indicated. Starting from the empty bobbin 13', a winding first takes place in order to apply a supply of thread to the bobbin 13'. As a result of the rotation of the bobbin 13', a detection is effected by the data carrier 22 which passes the reading/writing head 27' so that, upon each revolution of the bobbin 13', a pulse is given off over the line 51 to the counter/recording unit 52. After completion of the winding process, the counter/recording unit 52 contains a total number of pulses which represents a measure of the instantaneous supply of thread on the bobbin 13'. This total is then transmitted to the read/write head 27' via the line 50, so that said total is stored in the data carrier 22. The process explained up to here takes place to this extent on the winding device 39 of the sewing machine 1 or at an independent station for the winding of the bobbin 13'. After the insertion of an entirely or partially filled bobbin 13 into the looper 9 of the sewing machine, the total which has been stored in the data carrier 12 is read out via the read/write head 27 and transmitted over the line 55 to the counter/recording unit 53. During the sewing, the bobbin 13 is turned as a result of the pulling off of the looper thread, in which connection a pulse is once again detected each time that the data carrier 22 passes the read/write head 27, i.e. upon each rotation of the bobbin 13, the pulse also being transmitted over the line 55 to the counter/recording unit 53. To this extent, the pulses detecting the rotations of the bobbin 13 during the sewing process represent a measure of the thread consumed.

In the counter/recording unit 53, the last-mentioned pulses are subtracted from the total which corresponded to the thread supply of the bobbin 13 before the sewing process which was just carried out and which was read, at the start of the sewing process—as previously mentioned—into the counter/recording unit 53. As soon as the result from the said determined total corresponding to the thread supply on the bobbin 13 and the pulses corresponding to the thread consumption during a sewing process which has been carried out assumes a value of zero or a specific residual value, the counter/recording unit 53 gives off a signal via the output line 58, which signal is used in known manner via a signal device, not shown, to indicate the consumption of thread. At the same time, this signal serves to record the existing value in the data carrier 22 which describes the supply of thread present at the time on this bobbin. For this purpose, the counter/recording unit 53 transfers the existing value over the line 54 to the read/write head 27.

If, upon the next sewing process, sewing is to be effected with a sewing thread of different color, then it is necessary to change the bobbin 13, 75. Before the change, the existing supply of thread on the bobbin 13, 75 to be replaced is recorded in the corresponding data carrier 22, 68 in the manner described above, i.e. the data carrier 22, 68 of said bobbin 13, 75 gives information at all times as to the existing amount of thread on this bobbin 13 or 75.

Depending on the embodiment of the data carrier 22 (see the embodiments shown in FIGS. 3 to 5 or the development, not shown but previously mentioned, of the data carrier 22 by a transmitting and receiving device which is installed in a hybrid circuit), the writing or reading of the total into or out of the data carrier 22 is carried out upon a relative movement of the latter with respect to the counter/recording head 27 or at standstill with suitable association of position of the data carrier 22 to the read/write head 27. The manner of operation of the invention in accordance with the embodiment shown in FIG. 6 differs in the following points from the embodiment shown in FIGS. 1 and 7 which has been described above:

1.) The data carrier 22 of the bobbin 13 is scanned in the read/write station 40, which is arranged separately from the sewing machine 1.

2.) The bobbin 13' inserted for winding into the winding device 39 is scanned with respect to its data carrier 22 by the write head 28 in cooperation with the additional read head 49, which, in accordance with FIG. 6, acts as pulse transmitter. Of course, in the embodiment of FIG. 6, instead of the write head 28 and the read head 49, there could also be used the read/write head 27' shown in FIG. 1.

In all other respects the manner of operation of the embodiment according to FIG. 6 is similar to the manner of operation of the embodiment according to FIGS. 1 and 7, so that further explanation of the manner of operation of the embodiment in accordance with FIG. 6 can be dispensed with.

A further solution of the object is described below with regard to its construction with reference to the additional FIGS. 8 and 9.

The sewing machine 1 shown in FIG. 1 is provided in the region of the winding device 39 with a reading head 60 instead of the read/write head 27' and in the region of the looper 9 with a read head 61 instead of the read/write head 27. Within the control 36, there is contained a counter/recording unit 62 and a control part 63. The control 36 is connected to the read head 60 over a line 64 and to the read head 61 over a line 65. Furthermore, the control part 63 is connected from a circuit standpoint via a connecting line 66, and the counter/recording unit 62 via a connecting line 67, to a data carrier 68 which is provided as external, and therefore separate, component and can, for instance, have a magnetizable strip or a volatile memory component. The data carrier 68 contains individual storage places which are diagrammatically indicated by 69, 70 and 71 in FIG. 8. All storage places of the data carrier 68 are divided in each case into an address field 72 and a data field 73, as shown for instance, at the storage place 70 in FIG. 8. As can be further noted herefrom, the address field 72 bears the number 31 and the data field 73 the number 2604. According to the showing in FIG. 8, the storage place 69 contains the number 0 in its data field, which is not otherwise designated, and the storage place 71 contains the number 733 in its data field, which is not otherwise designated. Finally, the counter/recording unit 62 is also provided with an output line 74 which produces a connection with a signal device, not shown in detail, for instance an indicating light.

In this solution, a bobbin 75 is used the construction of which is fundamentally the same as the previously customary bobbins. In addition, the bobbin 75 is provided on the outside of a flange 76 with a coding 77 which corresponds to an individual number of each individual bobbin. On basis of this development, it is possible to identify each individual bobbin out of a number of bobbins 75 which are in use.

In accordance with FIG. 9, the coding 77 is indicated by a wide line 78 and several narrow lines 79. On basis of the development of the lines 78 and 79, different pulse widths result which the control 36 compares with each other so that the wide line is clearly recognized as start of the coding 77. To this extent, the coding 77 in accordance with the showing in FIG. 9 is developed in such a manner that, on the one hand, an unambiguous counting of each revolution of the bobbin 75 is possible by one of the read heads 60 or 61 passing the coding 77 and, on the other hand, an unambiguous identification of each individual bobbin is possible.

The coding of the bobbin 75 takes place in the manner that empty fields 80 on the annular circular surface 81 are blackened in accordance with a coding algorithm in corresponding manner by means of a felt marker. Thus, it is easy to effect or apply a coding on subsequently delivered neutral bobbins.

However, it is also conceivable to obtain data of a bobbin by, in addition to the coding, providing a mark which, together with a read head which is provided specifically for this, serves to count each revolution of the bobbin.

The manner of operation of the device of the invention, with respect to the solution shown in FIGS. 8 and 9, will be described below:

As in the previous description of the manner of operation of the solution in accordance with FIG. 7, a symbolic showing by the arrows 56, 57 has been selected also in FIG. 8. Starting from an empty bobbin 75, a winding process on the winding device 39 first takes place (compare FIGS. 1 and 7) so as to provide a supply of thread on the bobbin 75. As a result of the turning of the bobbin 75, the coding 77 moves past the read head 60 once upon each revolution of the bobbin 75. Already after the first passage, the series of pulses identifying the characterizing number of the bobbin 75 is given off over the line 64 to the control 36. The control part 63 of the control 36 selects a storage place in the data carrier 68 corresponding to the coding 77, which place can, for instance, be the storage place 69. In accordance with the showing in FIG. 8, the storage place 69 is occupied with the number 0 in its data field 73, which is not further designated. Upon further winding upon each revolution of the bobbin 75, a series of pulses identifying the bobbin 75 is given off via the read head 60 over the line 64 to the control 36, the counter/recording unit 62 detecting each of these revolutions as a counting process. The winding process is finally concluded in customary manner via mechanical means so that the bobbin 75 is 100% full. The counter reading obtained at this time by the counter 62 is transmitted over the line 67 to the data field of the previously selected storage place 69 and stored in the data carrier 68. Several bobbins 75 can be wound, for instance, with threads of different color and in different amounts in the manner described, so that corresponding data have been deposited in the data carrier 68 in the corresponding storage spaces 69, 70 and 71 respectively.

For the sewing process, the operator of the sewing machine 1 places one of these wound bobbins into the looper 9 so that the actual sewing process can then commence. Upon the first passage of the read head 61 past the coding 77, a series of pulses characterizing the number of the bobbin 75 is transmitted over the line 65 to the control 36. Selection of the storage place corresponding to the bobbin in question is now first of all effected in the control part 63, namely the storage place 71 in FIG. 8. After the selection of this storage place 71, the control 36 receives, over the connecting line 67, data concerning the content of the value deposited in the data field, which here has the value 733. In each case upon further revolution of the bobbin 75 during the sewing, another train of pulses is transmitted over the line 65 to the counter/recording unit 62, which is then able, in its turn, to effect a counting process and thus total a number corresponding to the consumption of thread necessary for the sewing process. As soon as the number corresponding to the consumption of thread corresponds to the number deposited in the data field of the storage space addressed (represented as No. 733 in FIG. 8), the counter gives off a signal over the output line 74. This signal serves not only for the response of the signal device, not shown here, but also to introduce a stop process over the line 59 (see FIGS. 1 and 6) for the sewing machine 1 and to write a new entry of data into the updated data field. Since, in the example just explained, the supply of thread on the bobbin 75 has now reached the value 0, an input with the value 0 is effected into the data field addressed.

The last-mentioned sewing process can, however, also take place in the manner that, due to a change in color becoming necessary, the bobbin 75 still contains a certain residual amount of thread, i.e. a certain thread supply. In this case also, the counter/recording unit 62 transmits to the corresponding data field over the connecting line 67 a difference value which corresponds to the supply of thread still remaining on the bobbin 75, which value has been formed from the supply of thread originally present and the consumption of thread of the bobbin 75.

Figure 10:
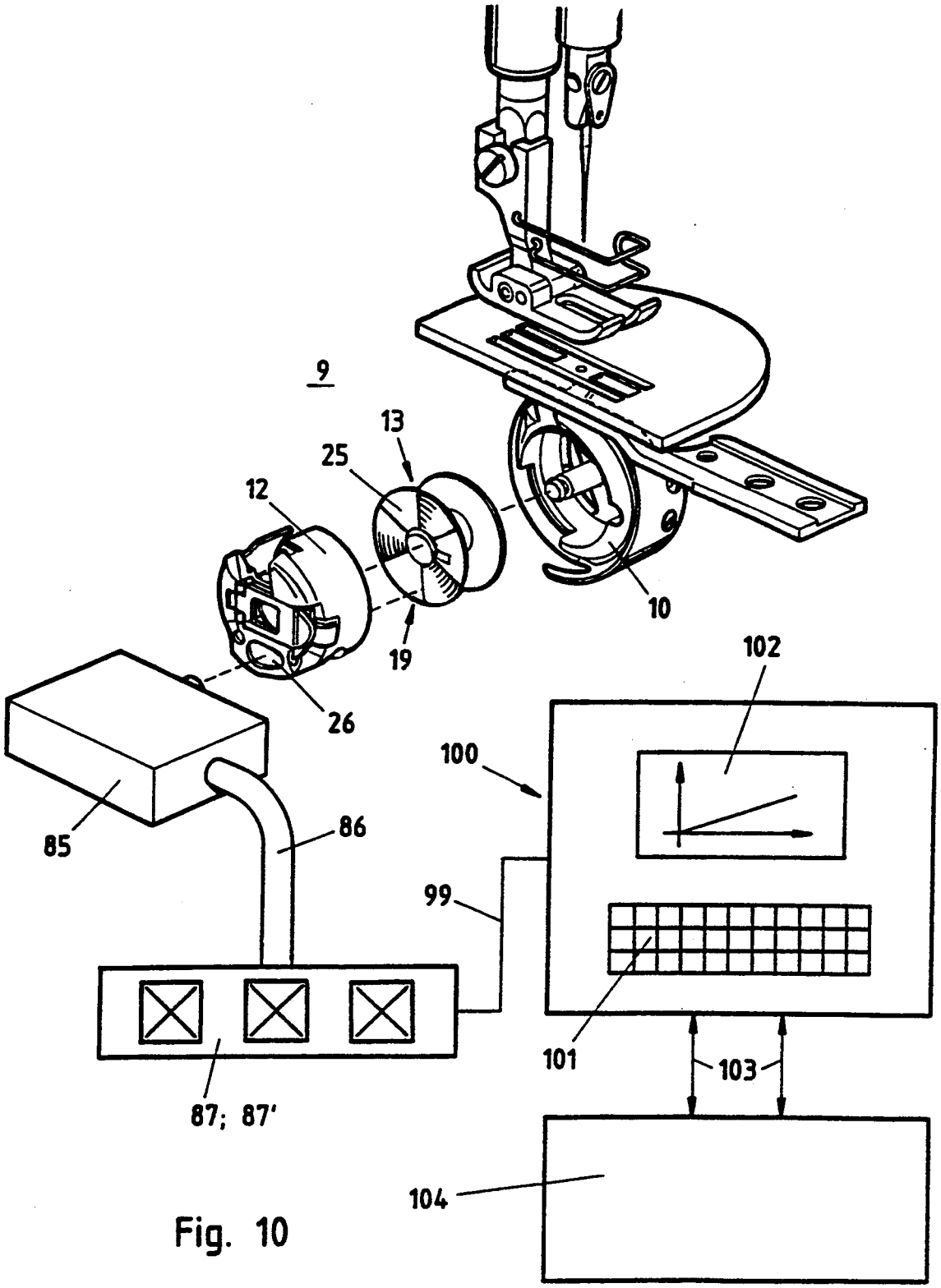
FIG. 10 is a simplified perspective view of the components necessary for the carrying out of the method.

The following description applies with respect to the method of the invention:

The looper 9 of a lock-stitch sewing machine 1, shown in an exploded view in FIG. 10, consists of the bobbin-housing upper part 12, the bobbin 13, and the bobbin-housing lower part 10. On the outside of the front flange 19 of the bobbin 13, there is arranged at least one mark 25 in the form of known light-dark sectors which is detected by a sensor 85. For this purpose, the opening 26 is provided in the bobbin-housing upper part 12, through which opening a beam of light which is sent out by the sensor 85—preferably an optical reflex coupler—and reflected by the flange 19 can pass. In this way, due to the rotation of the bobbin 13 upon the winding as well as the partial rotation of the bobbin 13 upon the sewing, pulses are produced which represent the turns of the looper thread present on the bobbin 13 and thus also the degree F to which the bobbin 13 is full. These pulses are conducted over a connecting line 86 to at least one counter 87, which is designed in this case as incremental and decremental counter. However, it would be better to use two or more separate counters 87', 87'', since ordinarily, winding is always effected during the sewing process and, in the event of the use of only one counter 87, the pulses would interfere with each other and there would be waiting times.

As mark 25 for the production of the pulse of the rotating bobbin 13, it is very suitable to supply an opening or several openings, preferably at the same distance apart, in the flange 19 since such marking is very insensitive in the relatively rough sewing operation. Said openings are preferably developed as holes in the flange 19. Since this development has been used for a long time—for instance, for reducing the mass of steel bobbins—the showing thereof in the figures has been dispensed with. In order to increase the precision upon the production of the pulse, it is advisable to arrange a large number of openings in the flange 19 or to arrange a large number of light-dark sectors on the outside of the flange 19.

In actual sewing operation, there are always several bobbins 13 which are filled to a greater or lesser extent and are used alternately for a corresponding sewing process. In order to prevent confusion, the bobbins 13 are to be characterized by visual coding or by machine-readable codings. For visual coding, the ability of the human eye to distinguish shades of color can be used, in the manner that each bobbin is provided, at least on its flanges 19, 20 on the outside, with different colors—in the case of aluminum bobbins, by the well-known Eloxal process—16 to 32 different shades of color being generally sufficient.

Figure 12:
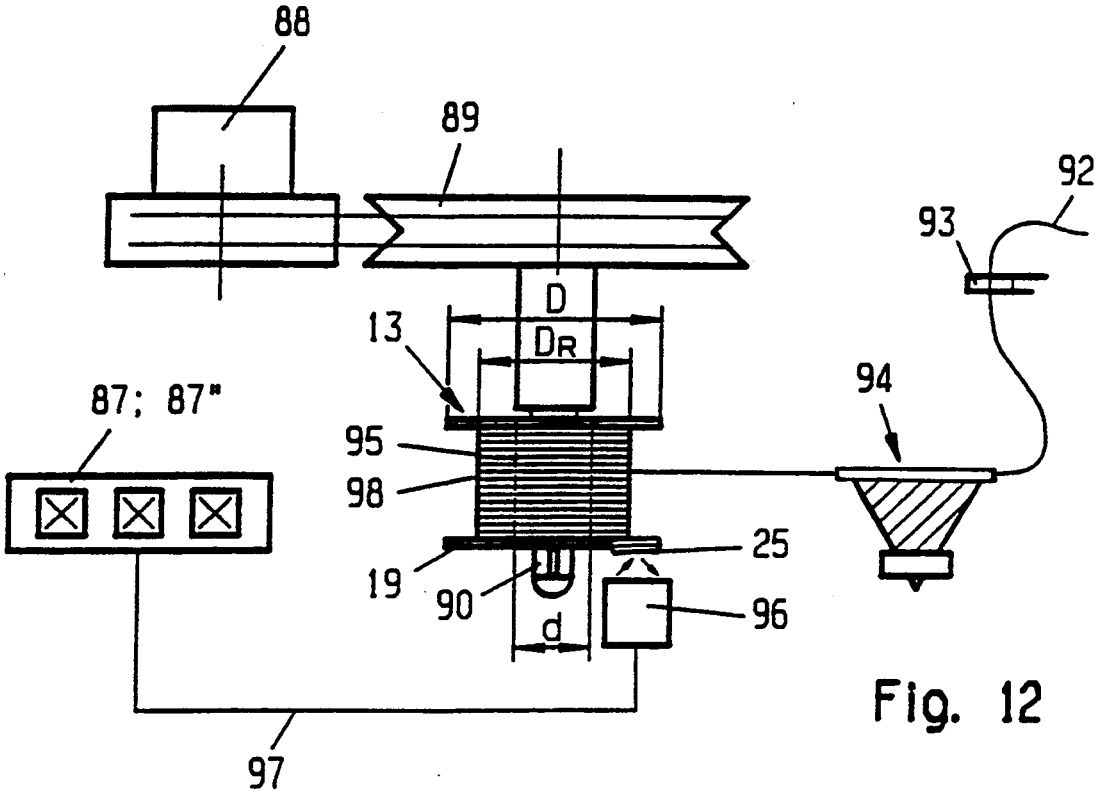
FIG. 12 is a simplified top view of the winding device.

FIG. 12 shows a known winding device in top view, a winder wheel 89, driven by a motor 88, having a receiving pin 90. This pin receives the empty bobbin 13 which in known manner is wound, upon the winding with a sewing thread 92 taken from an external roll of yarn 91. The sewing thread is guided through a thread guide eye 93 and a disk tensioner 94 operating with force-lock and then wound in known manner around a bobbin hub 95. In this connection, a few turns are preferably first of all wound on by hand with the bobbin 13 stationary.

The marks 25 provided on the outside of the flange 19 and the holes provided in the flange 19 are detected by a second sensor 96 and forwarded via a line 97 to the counter 87 (see FIG. 12), it being very advisable—as previously mentioned—for a second counter 87'' to be associated with the sensor 96. The revolutions of the bobbin 13 which are effected from the start of the winding until the end of the winding are therefore monitored by the sensor 96, the pulses produced thereby, with the full bobbin 13, being counted upward by the counter 87, 87' up to a maximum number of pulses $Z_{max}$. The exact determination of $Z_{max}$ presupposes, of course, a suitable winding process in which the winding layers lie properly one over the other and in which the last winding layer ends, as far as possible, flush with the outside diameter of the bobbin flange 19, 20.

Upon sewing—as already mentioned above—the revolutions of the bobbin 13 caused by the removal of thread from said bobbin are detected by the sensor 85 and at the end of this sewing process the number of pulses $Z_{act}$ is determined by downward counting of the counter 87, 87'. Said number of pulses represents the amount of thread of the bobbin 13 consumed upon the sewing and is referred to the diameter $D_R$ of the remaining package of thread 98. The counters 87 and 87', 87'' are functionally connected via a line 99 with a computer unit 100, whereby the number of pulses $Z_{max}$ and $Z_{act}$ are entered into the computer unit 100. The latter also includes a keyboard 101 as well as the display 102. After introduction of the most important geometrical data of the bobbin 13, namely outside diameter D and diameter d of the bobbin hub 95, by means of the keyboard 101, and after the reading in of the number of pulses $Z_{max}$ and $Z_{act}$, the existing degree of filling F of the bobbin 13 is calculated in the computer unit 100 in accordance with algorithms described below and is shown on the display 102.

The computer unit 100 is finally operatively connected via the lines 103 with a control 104 for the sewing machine 1.

Figure 11:
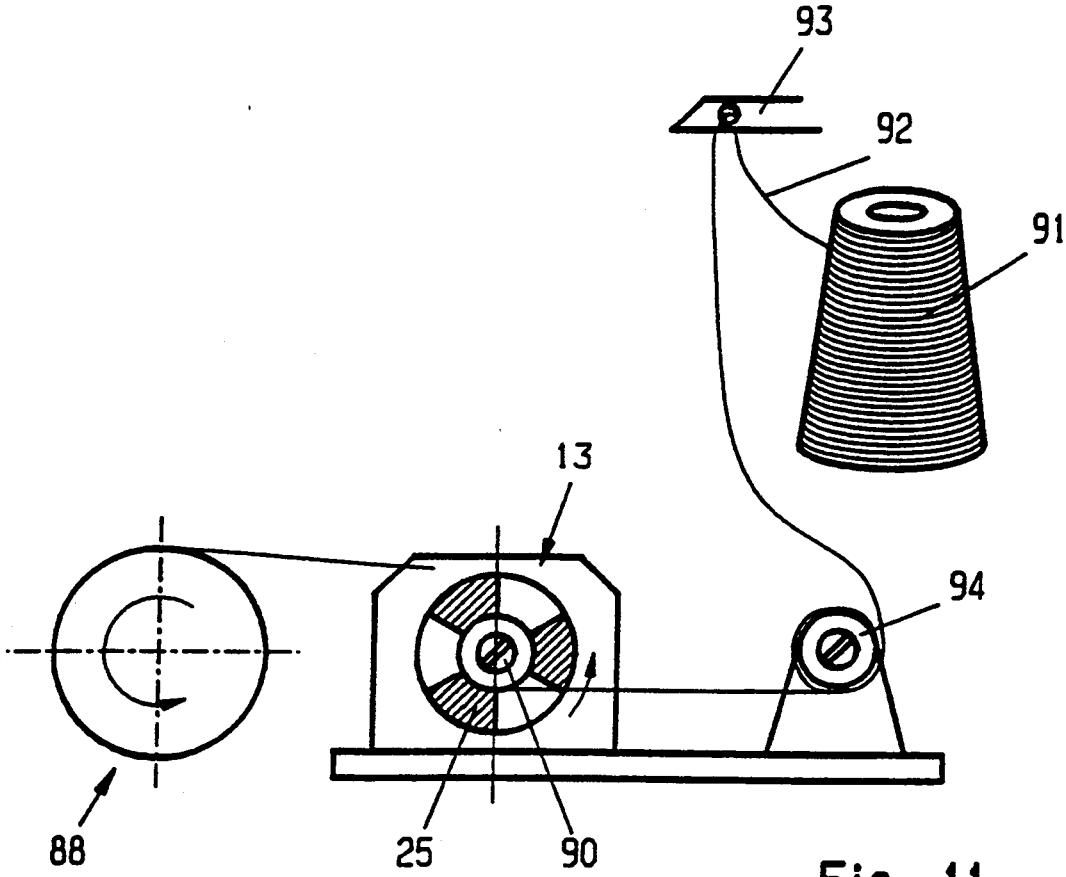
FIG. 11 is a simplified winding device for the winding of a looper-thread bobbin.

The carrying out of the method of the invention is described below:

Upon the winding of thread on an empty bobbin 13 by means of the winding device shown in FIGS. 11 and 12, the sensor 96 detects the passage of the mark 25 during the rotation of the bobbin 13 and the number of pulses $Z_{max}$ is determined by upward counting in the counter 87, 87''. Upon sewing, the intermittent rotation of the bobbin 13 is monitored by the sensor 85, which also detects the passage of the mark 25 and determines the number of pulses $Z_{act}$ by downward counting in the counter 87, 87'. The number of pulses $Z_{max}$ and $Z_{act}$ which are read into the computer unit 100 are subtracted and give the number of pulses $Z_R$, which represents the supply of thread still present on the bobbin 13 after the sewing process. The determination of the degree of filling F of the bobbin 13 is to be feasible only with inclusion of the parameters $Z_{max}$, $Z_{act}$, D and d. In order to arrive at such an algorithm, the following considerations are taken into account.

The degree of filling F results from the relationship $$F = \frac{L_R}{L_{max}} \cdot 100\%$$

in which $L_R$ represents the length of thread defined by the instantaneous winding diameter $D_R$ present on the bobbin 13. Assuming that, upon the winding on of one turn during the winding process, in each case one pulse is produced by the sensor 96, the maximum number of pulses $Z_{max}$ of the duly filled bobbin 13 shown in FIG. 13 results in the event of the following assumptions:

—inner bobbin width b equal to 10 millimeters,

—maximum package diameter D equal to 22 millimeters,

—hub diameter d equal to 8 millimeters,

—thickness (diameter) of a monofilament sewing thread s equal to 0.5 millimeter.

Figure 13:
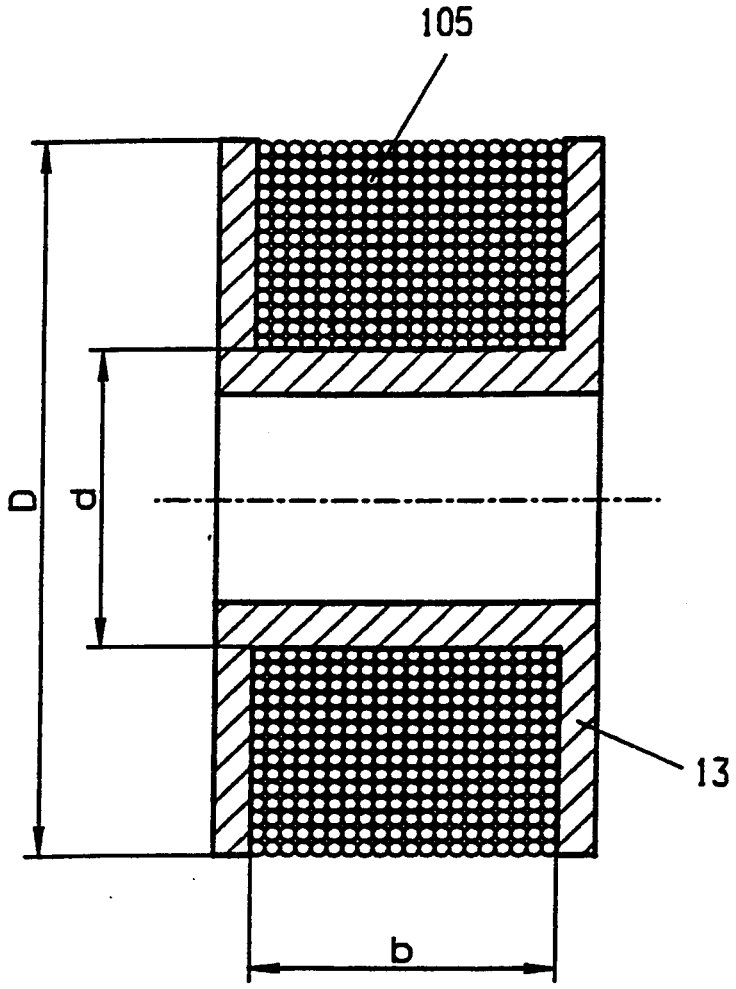
FIG. 13 is a side view of a bobbin, shown in section on a larger scale.

Under these assumptions, there is the result that 20 turns are present in a layer on the bobbin shown in FIG. 13, since the width b, which is 10 millimeters, divided by the size s, which is 0.5 millimeters, gives the number of turns, namely 20. The number of layers upon proper winding is 14 since half of the difference D, which is 22 millimeters, and d which is 8 millimeters, gives, first of all, 7 millimeters, and the yarn size s, which is equal to 0.5 millimeters, is present 14 times in this amount. The filled bobbin 13 therefore contains 280 turns and, under the assumptions made above, the number of pulses $Z_{max}$ is 280.

In general, in this case $Z_{max}$ can be obtained from the relationship:

$$Z_{max} = \frac{b}{s} \cdot \frac{\frac{D-d}{2}}{s}$$

$Z_{max}$ thus being $$Z_{max} = \frac{b}{2s^2} \cdot (D - d)$$

For the twisted yarns which are very frequently used in practice, the size of the sewing thread must be calculated from the relationship $$s = \sqrt{\frac{4 \cdot T \cdot Z}{\pi \cdot \rho \cdot 10^6}} \text{ (centimeters)}$$

which can be noted from the journal "Vision und Identifikation Magazin", Vol. 2, No. 1, page 29, 1988. In the case of very bulky or voluminous sewing threads, the theoretical diameter s referred to above is also influenced by a compression factor $K \approx 0.89$. For the algorithm to be derived below, the yarn size s, as well as the inner width b of the bobbin 13, plays no role, since these values drop out as a result of mathematical cancellation. This statement is based on the fact that the determination of the actual degree of filling F always refers only to one and the same bobbin 13.

The maximum length $L_{max}$ of the properly filled thread package wound on the bobbin 13 results from $$L_{max} = Z_{max} \cdot \pi \cdot \frac{D + d}{2}$$

If "N pulses" are produced when the winding is applied, then $Z_{max}$ is to be divided by N.

If the remaining length of thread on the bobbin 13 is defined as $L_R$, the actual degree of filling F of the bobbin referred thereto results from $$F = \frac{L_R}{L_{max}} \cdot 100\%$$

-continued in which $$L_R = (Z_{max} - Z_{act}) \cdot \pi \frac{D_R + d}{2}$$

and $$L_{max} = Z_{max} \cdot \pi \cdot \frac{D + d}{2}$$

By substitution, we obtain:

$$F = \frac{(Z_{max} - Z_{act}) \cdot \pi \cdot \frac{D_R + d}{2}}{Z_{max} \cdot \pi \cdot (D + d)} \cdot 100\%$$

from which, by reduction, we obtain:

$$F = \frac{Z_{max} - Z_{act}}{Z_{max}} \cdot \frac{D_R + d}{D + d} \cdot 100\%$$

In order to eliminate the variable $D_R$ from the last two equations, the degree of filling F is derived from another relationship which is based on the following consideration:

The length of thread $L_{max}$ can be arranged in a cylindrical tubular thread package having the dimensions D, d and b, the thread package taking up a volume $V_{max}$.

The remaining thread length $L_R$ can be arranged in another thread package having the dimensions $D_R$, d and b, the latter assuming a volume $V_R$.

In this way, the degree of filling F can also be calculated from the relationship $$F = \frac{V_R}{V_{max}} \cdot 100\%$$

Herein:

$$V_R = \frac{D_R^2 \cdot \pi}{4} \cdot b - \frac{d^2 \cdot \pi}{4} \cdot b$$

By algebraic simplification, we obtain:

$$V_R = (D_R^2 - d^2) \cdot \frac{\pi}{4} \cdot b$$

Furthermore, we have:

$$V_{max} = \frac{D^2 \cdot \pi}{4} \cdot b - \frac{d^2 \cdot \pi}{4} \cdot b$$

Simplified, this gives:

$$V_{max} = (D^2 - d^2) \cdot \frac{\pi}{4} \cdot b$$

We thus have:

$$F = \frac{D_R^2 - d^2}{D^2 - d^2}$$

By equating the two sides of the equation describing the degree of filling F, we obtain:

$$\frac{D_R^2 - d^2}{D^2 - d^2} = \frac{Z_{max} - Z_{act}}{Z_{max}} \cdot \frac{D_R + d}{D + d}$$

or, written differently:

$$\frac{D_R^2 - d^2}{D^2 - d^2} = 1 - \frac{Z_{act}}{Z_{max}} \cdot \frac{D_R + d}{D + d}$$

By simplification, we obtain:

$$\frac{D_R - d}{D - d} = 1 - \frac{Z_{act}}{Z_{max}}$$

and from this:

$$D_R = \left(1 - \frac{Z_{act}}{Z_{max}}\right) \cdot (D - d) + d$$

or, after solution, $$D_R = D - d - \frac{Z_{act}}{Z_{max}} \cdot (D - d) + d$$

After further simplification, we obtain from the last relationship $$D_R = D - \frac{Z_{act}}{Z_{max}} \cdot (D - d)$$

If this formula is inserted into the relationship derived above $$F = \frac{D_R^2 - d^2}{D^2 - d^2} \cdot 100\%$$

then we finally obtain $$F = \frac{\left[D - \frac{Z_{act}}{Z_{max}} \cdot (D - d)\right]^2 - d^2}{D^2 - d^2} \cdot 100\%$$

From this formula it is clear that for progressive determination of the degree of filling F by the computer unit 100, only the following parameters are necessary:

—the number of pulses $Z_{max}$ determined upon the winding and stored in a maximum value storage;

—the number of pulses $Z_{act}$ continuously determined during the sewing and which, at the end of a sewing process, indicates the thread consumed as well as the remaining length of thread present on the bobbin 13, —the geometrical data D and d, which—since they represent machine-specific constant values—need be read only once into the computer unit 100.

The results of the automatic calculation of the degree of filling can be transmitted to the control 104 of the sewing machine 1 in order —to indicate that a change of bobbin will soon be necessary, —to introduce the following operations, for instance, cutting of thread, lifting of presser foot, and others, —to stop the sewing machine, —to switch the sensor 85 in connection with the computer unit 100 to another type of operation—for instance as limit thread monitor—in order, in this way, to distinguish the absence of pulses due to the breaking of the thread from the end of winding.

In addition to indication of the degree of filling F in the display 102, the residual thread length $L_R$ can also be indicated, it being calculated by the computer unit 100 in accordance with the formula $$L_R = \frac{F}{100\%} \cdot \frac{Z_{max}}{N} \cdot \pi \cdot \frac{D+d}{2}$$

under the assumption that "N pulses" are produced upon the unwinding of a turn from the bobbin 13.

Moreover, in accordance with the formula for the degree of filling F, upon inputting or measurement of the yarn size S, and/or stitch length, and/or thickness of the fabric, and the action of the pulses detected by the sensor 85, via the computer unit 100, the sewing path still to be sewn can be continuously calculated and shown in the display 102.

In addition, by the automatic or manual inputting of the length of a seam to be produced into the keyboard 101, the computer unit 100 can calculate whether the length of seam to be produced can still be sewn.

We claim:

1. A method of monitoring the looper-thread supply in a double lock-stitch sewing machine in which, by detection of a marking provided on the outside of a bobbin present in the looper, pulses are produced by a sensor upon the winding due to the rotation of the bobbin and are given off to at least one counter and in which, furthermore, pulses are produced during the sewing by the intermittent rotation of the bobbin by a further sensor and given off to at least one counter, the method comprising the steps of:

—identifying the bobbin by a marking on the outside of a flange on the bobbin,

—detecting, upon winding, by a first sensor, further marks on the outside of the flange of the bobbin to produce pulses which influence a degree of filling F of the bobbin and are incremented by the counter to a number of pulses $Z_{max}$, —detecting, during sewing, by a second sensor, the marks to produce pulses which affect the consumption of looper thread and are decremented in the counter to a pulse number $Z_{act}$, —inputting via a keyboard forming part of a computer unit the diameter D of the bobbin as well as the diameter d of a bobbin hub, —calculating in the computer unit, by subtraction of $Z_{max}$ and $Z_{act}$, a number of pulses $Z_R$ influencing the instantaneous degree of filling F of the bobbin —determining values of a thread length $L_{max}$ corresponding to the number of pulses $Z_{max}$ and a remaining length of thread $L_R$ from the diameter D of the bobbin and the diameter d of the bobbin hub, and —indicating on a display forming part of the computer unit the number of pulses $Z_{max}$ and the corresponding thread length $L_{max}$, as well as the number of pulses $Z_{act}$ and, at the end of the sewing, the number of pulses $Z_R$ as well as the remaining length of thread $L_R$ still present at this time on the bobbin.

2. A method according to claim 1, further comprising the step of feeding the pulses produced by the sensors to one of:

(a) a counter designed as an incremental and decremental counter, and (b) two separate counters for each sensor, one of the two separate counters cooperating with the first sensor and operating as an incremental counter, and the other counter cooperating with the second sensor and operating as a decremental counter.

3. A method according to claim 1, wherein the marking provided for the identification of different bobbins is unmistakably associated by visually readable or machine-readable marking with the counter or the counting values.

4. A method according to claim 1, further comprising the steps of: providing start, stop or thread-cut signals upon the action of the second sensor on the counter, and providing a signal to the counter upon the absence of pulses.

5. A method according to claim 1, wherein after the inputting of the bobbin geometrical data (D, d) and after the entry of the pulse numbers $Z_{max}$ and $Z_{act}$ into the computer unit, further comprising the steps of: calculating and showing in the display the degree of filling F continuously calculated in said computer unit in accordance with the formula $$F = \frac{\left[D - \frac{Z_{act}}{Z_{max}} \cdot (D-d)\right]^2 - d^2}{D^2 - d^2} \cdot 100\%,$$

and forwarding this calculated value to the machine control for the preparation of stop, bobbin-change or disturbance operations.

6. A method according to claim 5, further comprising the steps of: continuously calculating and showing in the display the sewing path still to be sewn in accordance with the formula for the degree of filling F, upon the inputting or measurement of the yarn size s and/or stitch length and/or thickness of fabric and action of the pulses detected by the sensor via the computer unit.

7. A method according to claim 5, further comprising the steps of: automatic or manual inputting of the length of seam to be produced into the keyboard, and calculating in the computer unit whether the length of seam can still be sewn.

* * * * *